US011965271B2

(12) United States Patent
Zheng et al.

(10) Patent No.: US 11,965,271 B2
(45) Date of Patent: Apr. 23, 2024

(54) FLEXIBLE ELECTROLUMINESCENT FIBER FOR EMBROIDERY

(71) Applicant: Shanghai Kerun Phosphor Technology Co., Ltd., Shanghai (CN)

(72) Inventors: Yan Zheng, Shanghai (CN); Shufan Geng, Shanghai (CN); Jinshui Zhou, Shanghai (CN); Ruijun Zhang, Shanghai (CN); Chengyi Hou, Shanghai (CN); Hongzhi Wang, Shanghai (CN); Yang Guo, Shanghai (CN); Zhilei Yuan, Shanghai (CN); Lei Chen, Shanghai (CN); Kerui Li, Shanghai (CN); Suwen Guo, Shanghai (CN); Bangzuan He, Shanghai (CN); Kaiyan Zheng, Shanghai (CN); Lihua Quan, Shanghai (CN)

(73) Assignee: Shanghai Kerun Phosphor Technology Co. , Ltd, Shanghai (CN)

( * ) Notice: Subject to any disclaimer, the term of this patent is extended or adjusted under 35 U.S.C. 154(b) by 158 days.

(21) Appl. No.: 17/689,936

(22) Filed: Mar. 8, 2022

(65) Prior Publication Data

US 2022/0195632 A1 Jun. 23, 2022

(30) Foreign Application Priority Data

Dec. 20, 2021 (CN) ..... 202123204624.X

(51) Int. Cl.
*D02G 3/44* (2006.01)

(52) U.S. Cl.
CPC ..... *D02G 3/441* (2013.01); *D10B 2101/20* (2013.01); *D10B 2321/022* (2013.01); *D10B 2331/02* (2013.01); *D10B 2331/06* (2013.01); *D10B 2331/10* (2013.01); *D10B 2401/20* (2013.01)

(58) Field of Classification Search
CPC ..... D02G 3/441; D02G 3/46
See application file for complete search history.

(56) References Cited

U.S. PATENT DOCUMENTS 5,213,865 A * 5/1993 Yamada ..... B60N 3/044 57/232
5,753,381 A * 5/1998 Feldman ..... D04C 1/02 313/511
5,906,004 A * 5/1999 Lebby ..... D03D 15/242 2/905

(Continued)

*Primary Examiner* — Bao-Thieu L Nguyen

(57) ABSTRACT

A flexible electroluminescent fiber for embroidery sequentially includes: metal core wires, a light-emitting layer, a transparent conductive layer, a filament, and a protective paint, wherein a quantity of the metal core wires is an even number, and the metal core wires are pasted together before being wrapped by the light-emitting layer; the light-emitting layer is coated with the transparent conductive layer; the protective paint and the filament are exterior to the transparent conductive layer; the metal core wires emit light through energizing; a diameter of the electroluminescent fiber is 0.1-0.3 mm, and a 20-36V safe voltage is applied for emitting light. The flexible electroluminescent fiber of the present invention has sufficient tensile force, and smooth and soft surface. Appearance and hand feeling of the present invention are the same as those of clothing textile fibers.

6 Claims, 1 Drawing Sheet

(56) References Cited

U.S. PATENT DOCUMENTS 6,096,666 A * 8/2000 Jachimowicz ..... D03D 15/547 139/420 R
6,913,713 B2 * 7/2005 Chittibabu ..... D02G 3/441 257/451
7,401,961 B2 * 7/2008 Longatti ..... D04C 1/12 362/311.06
7,737,633 B2 6/2010 Zheng
8,063,307 B2 * 11/2011 Bukshpun ..... A41D 1/005 174/117 F
8,541,943 B2 * 9/2013 Zheng ..... H01B 3/006 313/512
9,054,248 B2 * 6/2015 Kalyanaraman ..... H01L 31/03926
9,445,186 B2 9/2016 Zheng et al.
9,822,470 B2 * 11/2017 Manipatruni ..... D01D 5/34
10,273,600 B1 * 4/2019 Bharadwaj ..... G02F 1/13725
10,826,006 B2 * 11/2020 Giray ..... H10K 30/30
11,479,886 B2 * 10/2022 Abouraddy ..... D03D 15/533
2005/0040374 A1 * 2/2005 Chittibabu ..... D02G 3/441 257/E31.038
2007/0046192 A1 * 3/2007 Akai ..... H10K 50/828 313/506
2007/0079867 A1 * 4/2007 Chittibabu ..... H01G 9/2031 136/252
2008/0036375 A1 * 2/2008 Zheng ..... H01B 1/08 313/509
2008/0182103 A1 * 7/2008 Chung ..... D02G 3/441 57/232
2013/0134868 A1 * 5/2013 Zheng ..... H01B 3/105 313/509
2013/0263351 A1 * 10/2013 Tao ..... D02G 3/441 174/128.1
2014/0170919 A1 * 6/2014 Manipatruni ..... D02G 3/441 442/330
2014/0170920 A1 * 6/2014 Manipatruni ..... D03D 1/0088 442/187
2018/0026217 A1 * 1/2018 Giray ..... H10K 30/81 136/256
2019/0287910 A1 * 9/2019 Keating ..... D03D 15/292
2020/0398527 A1 * 12/2020 Yao ..... B32B 7/022
2021/0018813 A1 * 1/2021 Paolini, Jr. ..... G02F 1/167
2021/0047757 A1 * 2/2021 Cleveland ..... D02G 3/36
2021/0363670 A1 * 11/2021 Abouraddy ..... D03D 15/54

* cited by examiner

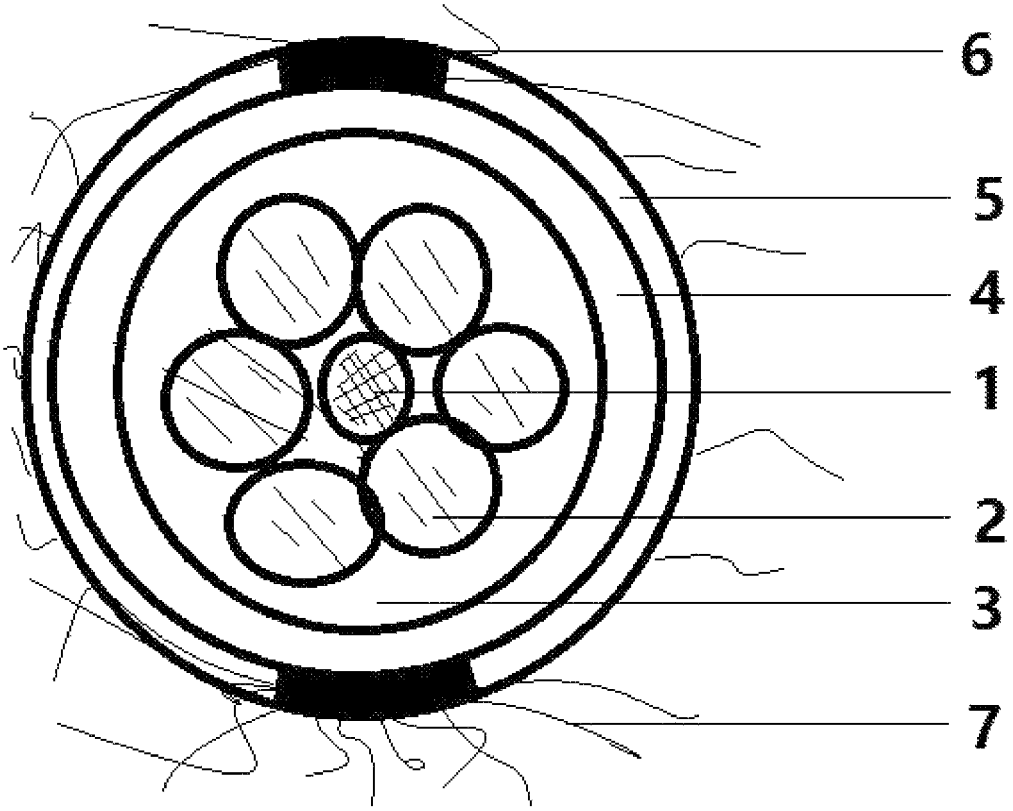
6
5
4
1
2
3
7

FLEXIBLE ELECTROLUMINESCENT FIBER FOR EMBROIDERY

CROSS REFERENCE OF RELATED APPLICATION

The present invention claims priority under 35 U.S.C. 119(a-d) to CN 202123204624.X, filed Dec. 20, 2021.

BACKGROUND OF THE PRESENT INVENTION

Field of Invention

The present invention relates to the application of light-emitting element in the technical field of textile.

Description of Related Arts

Most of the light-emitting elements used in the fields of clothing, textile, and embroidery are LED fiber optic lights. The end face of the LED point light source fiber makes the light-emitting pattern effect discontinuous, and the fiber and LED thread lights cannot be bent or sewed. The conventional electroluminescent wire is provided with a conductive layer connected to a metal external electrode, or uses multi-core multi-way electrodes to control the flashing of the luminescent fiber. As a result, the diameter of the electroluminescent wire is usually greater than 1 mm. Furthermore, high-voltage luminescence makes it cannot be safely used with low voltage, the bending angle is small makes it easy to break. For example, in U.S. Pat. Nos. 7,737,633, 8,541,943 and 9,445,186, the surface plastic protective layers inhibit the application in continuous production equipment for embroidery and sewing due to high resistance, and the luminescent fiber body cannot be integrated with textiles and clothing.

According to the present invention, a flexible electroluminescent fiber for embroidery is sequentially structured as follows: metal core wires, a light-emitting layer, a transparent conductive layer, a filament, and a protective paint, wherein an amount of the metal core wires is an even number, and the metal core wires are pasted together before being wrapped by the light-emitting layer. The light-emitting layer is coated with the transparent conductive layer. The protective layer and the filament are exterior to the transparent conductive layer. The metal core wire emits light by energizing. A diameter of the electroluminescent fiber is 0.1-0.3 mm, and a 20-36V safe voltage is applied for emitting light.

According to the present invention, the flexible electroluminescent fiber for embroidery has sufficient pulling force, wherein surface thereof is smooth and soft, and is identical to the appearance and hand feeling of the garment textile fiber. The present invention improves the surface and structure of the electroluminescent fiber, so that it can be used for weaving and machine embroidery. The electroluminescent fiber of the present invention can be widely used in luminous clothing, luminous embroidery patterns, luggage, toys, tents, parasols, and can also be used for festival decoration, furniture, clothing, automobiles, paper cards, mobile phone electronic luminous accessories, architectural decoration, etc.

SUMMARY OF THE PRESENT INVENTION

The present invention provides a flexible electroluminescent fiber for embroidery, sequentially comprising: metal core wires (2), a light-emitting layer (3), a transparent conductive layer (4), a filament (6) and (7), and a protective paint (5), wherein a quantity of the metal core wires is an even number, and the metal core wires are pasted together before being wrapped by the light-emitting layer; the light-emitting layer is coated with the transparent conductive layer; the protective paint and the filament are exterior to the transparent conductive layer; the metal core wires emit light through energizing; a diameter of the electroluminescent fiber is 0.1-0.3 mm, and a 20-36V safe voltage is applied for emitting light.

The metal core wires are enameled copper wires with a diameter of 0.01-0.05 mm; a quantity of the enameled copper wires is an even number, and capacitances of the enameled copper wires are identical. According to the present invention, the electroluminescent fiber has no external electrode but must be provided with the transparent conductive layer. An enameled layer outside the copper wire can provide an electric field effect. A thickness of the enameled layer is 10-50 nanometers, so that the transparent conductive layer can generate an induced electric field at a low voltage, thereby emitting strong light. Without the transparent conductive layer, there will be no or only weak light.

The metal core wires are evenly wrapped by the light-emitting layer, and a thickness of the light-emitting layer is 0.03 mm. The enameled copper wires, which form the metal core wire, are intertwined with each other or arranged regularly. The enameled copper wires are wrapped with self-adhesive paint. The enameled copper wires can be pasted together adjacently, and then coated with the light-emitting layer. The metal core wires are evenly divided into two groups of equal numbers to form two electrodes, which are respectively connected to a dedicated inverter driver to be energized, thereby emitting light. The light-emitting layer is formed by an electroluminescent material and an elastic paint, wherein the light-emitting layer is suitable for automatic machine embroidery and sewing since it will not break. In the present invention, no titanium dioxide insulating layer is used. The titanium dioxide insulating layer or high dielectric constant medium layer will greatly increase the luminescent voltage of the electroluminescent fiber, and make the lighting-emitting layer easy to break and short circuit during sewing.

The light-emitting layer is continuously coated by the transparent conductive layer; the transparent conductive layer is nano-conductive ITO, zinc oxide, nano-silver wires, or conductive polymers. The transparent conductive layer uses structures, materials and preparation processes of conventional electroluminescent fiber. The present invention has no external electrode wire. Low-voltage continuous high-intensity light emission requires a sufficient transparent conductive layer, which uses the coated transparent conductive layer to achieve segmental light-emitting, single-sided light-emitting, and gradient light-emitting. The special structure of the present invention changes the function of the conventional transparent conductive layer, and realizes various light-emitting phenomena with special effects. Although the structure of the present invention cannot support the multi-channel flicker control effect, the coating of the transparent conductive layer can realize segmental light emission, one-side light emission, and gradient light emission. The special structure of the present invention changes the function of the conventional transparent conductive layer, and realizes various special light-emitting effects. Although the structure of the present invention cannot support the multi-channel flicker control effect, the coating of the transparent conductive layer can realize the segmental light emission, the one-side light emission, and the gradient light emission. The transparent conductive layer of the present invention can realize low-voltage light emission, form an induced electric field structure, and form an optimal electroluminescence structure for interlayer capacitors. Without the transparent conductive layer, a voltage of more than 200 volts is required to emit light, and brightness is lower than that of the present invention.

The transparent conductive layer is wrapped with the filament, and the filament is transparent or translucent; the filament is organic filament with a diameter of 0.005-0.01 mm, the filament is a polypropylene fiber, a polyester fiber, a polyurethane fiber or a nylon fiber. The filament can be multiple or single, and can support and control a thickness of the protective paint. The filament improves a tensile force of the electroluminescent fiber, protects the transparent conductive layer from being scratched, and improves firmness and stability of the protective paint, which is beneficial to routine operations of embroidery and sewing machines, as well as increases luminous intensity.

The filament is segmentally coated with the protective paint which is colorless, transparent and insulating; the protective paint bonds the filament to surfaces of the light-emitting layer and the transparent conductive layer, while the filament provides support for the protective paint; the protective paint completely wraps the transparent conductive layer; a thickness of the protective paint equals to a diameter of the filament. The protective paint interacts with the filament to effectively improve softness, smoothness, firmness and stretchability of the electroluminescent fiber. As a result, appearance, hand feeling and softness of the electroluminescent fiber are similar to those of common fiber, which is beneficial to embroidery and sewing, and is beneficial to the integration of clothing. The electroluminescent fiber of the present invention can be woven into cloth to form warp and weft threads of large-area luminous woven cloth, or to form luminous patterns.

The metal core wires are arbitrarily combined in even numbers into two groups of electrodes, and the 20-36V safe voltage is provided by a special driver for emitting light. Due to the structure of the present invention, quantities of the electrodes in the two groups needs to be the same, so that the capacitance and current can be the same, and the luminous intensity can also be the same. If the quantity of the metal core wires is an odd number, uniformity of light emission will be lowered. The driver used in the present invention provides the safe voltage of 20-36V, or higher. To use DC 3-12V, frequency conversion and voltage conversion by the driving device are required. Due to the structure of the present invention, a starting voltage is lower than that of the conventional light-emitting fiber.

The electroluminescent fiber is used for garment sewing or embroidery thread in an independent form, a multi-strand parallel form or a multi-strand winding form, so that a garment or a pattern emits light under the safe voltage. The electroluminescent fiber can be mixed with conventional textile threads since hand feelings and usage are the same. Combinations of multiple electroluminescent fibers can also be used for pattern combinations. The color of electroluminescent fiber can be realized by luminescent materials and fluorescent dyes, or by coloring the protective paint and the filament.

The electroluminescent fiber uses colored fluorescence in the filament to show colors, and the filament with the colored fluorescence wraps the transparent conductive layer, in such a manner that emitted light is soft. Distribution of the filament with the colored fluorescence can greatly improve a luminous area of the electroluminescent fiber and increase visual effects. The colored fluorescence in the filament is stable and durable, whose effect is better than that of adding fluorescent dyes to a plastic sheath of the conventional light-emitting thread.

BRIEF DESCRIPTION OF THE DRAWINGS

FIGURE is a structural view of and electroluminescent fiber of the present invention.

Element reference: 1—center wire, 2—metal core wire, 3—light-emitting layer, 4—transparent conductive layer, 5—protective paint, 6—filament, 7—filament fiber.

DETAILED DESCRIPTION OF THE PREFERRED EMBODIMENT

A flexible electroluminescent fiber for embroidery is shown in FIGURE, which sequentially comprises: metal core wires 2, a light-emitting layer 3, a transparent conductive layer 4, a filament 6 or filament fiber 7, and a protective paint 5, wherein a quantity of the metal core wires is an even number, and the metal core wires are pasted together in a winding or parallel form, and then are fully wrapped by the light-emitting layer through a coating device; the light-emitting layer is coated with the transparent conductive layer through the coating device; the protective paint coats the transparent conductive layer through the coating device, and the protective paint are wrapped by the filament; the metal core wires are evenly divided into two sets of electrodes, so as to emit light through energizing; a diameter of the electroluminescent fiber is 0.1-0.3 mm, and a 20-36V safe voltage is applied for emitting light.

The metal core wire is an enameled copper wire with a diameter of 0.01-0.05 mm, and the diameter of 0.03 mm is easy to process. A quantity of the enameled copper wires is an even number such as 2, 4 or 6, and the enameled copper wires are regularly twisted with each other. The twisting method is the same as that of the conventional wires. A center wire 1 can be set in the middle during twisting, and the center wire makes stranding tension of the enameled copper wires more uniform. A thickness of an enameled layer of the copper wire is 10-50 nanometers. The enameled copper wire is commercially available, but a paint layer thereof should be thin to be conducive to low-voltage light emission. Paint wrapping the copper wire is conventional, which can be colorless, red or white, etc. A paint thickness is 5-20 microns, which is suitable for using under high voltage.

The metal core wires are evenly wrapped by the light-emitting layer, and a thickness of the light-emitting layer is 0.01-0.05 mm. Preferably, the thickness of the light-emitting layer is 0.03 mm is better, which is conducive to low-voltage operation of the light-emitting layer. The light-emitting layer is formed by electroluminescent material and elastic adhesive. The electroluminescent material is commercially available KPT grades such as D512S green, D417B blue and D321C white, and a particle size is 7-30 microns. The enameled copper wires, which form the metal core wire, are intertwined with each other or arranged regularly. The enameled copper wires are wrapped with self-adhesive paint. The enameled copper wires can be pasted together adjacently, and then coated with the light-emitting layer through the coating device. The metal core wires are evenly divided into two groups of equal numbers to form two electrodes, which are respectively connected to a dedicated inverter driver to be energized, thereby emitting light. The light-emitting layer is formed by an electroluminescent material and an elastic paint, wherein the light-emitting layer is suitable for automatic machine embroidery and sewing since it will not break.

The light-emitting layer is continuously coated by the transparent conductive layer; the transparent conductive layer is nano-conductive ITO, zinc oxide, nano-silver wires, or conductive polymers, and is coated by the coating device. The transparent conductive layer uses structures, materials and preparation processes of conventional electroluminescent fiber. The present invention uses the coated transparent conductive layer to achieve segmental light-emitting. If necessary, the present invention can form regularly distributed segments to emit light. One-side coating produces one-side light-emitting. Different coating thicknesses cause different resistances, so as to achieve gradient light-emitting. The special structure of the present invention changes the function of the conventional transparent conductive layer, and realizes various light-emitting phenomena with special effects. Conventional external electrodes, which are common in the technical field, can also be used in the structure of the present invention, but the special effects of the present invention cannot be achieved. If the present invention is provided with the external electrodes, the external electrodes can be combined and connected to the electrode of any group of the metal core wires. Of course, without the external electrode, the light emitting will not be affected.

The transparent conductive layer is wrapped with the filament, and the filament is transparent or translucent; the filament is organic filament 6 and filament fiber 7 combination with a diameter of 0.005-0.01 mm, the filament is a polypropylene fiber, a polyester fiber, a polyurethane fiber or a nylon fiber. The filament can be multiple or single, and is continuous. Preferably, the diameter of the filament is 0.01 mm. The filament can support and control a thickness of the protective paint. The filament improves a tensile force of the electroluminescent fiber and is anti-friction, protects the transparent conductive layer from being scratched, and improves firmness and stability of the protective paint, which is beneficial to routine operations of embroidery and sewing machines, as well as increases luminous intensity. The protective paint is applied first, and then a plurality of filaments are wound. After coating the protective paint, the filaments are wound. After the protective paint is dried, the filaments are adhered to the surface of the transparent conductive layer, so that the surface of the electroluminescent fiber is similar to that of a thread. Furthermore, the filament can protect the electroluminescent fiber during mechanical embroidery and sewing. The filament is segmentally coated with the protective paint which is colorless, transparent and insulating; the protective paint bonds the filament to surfaces of the light-emitting layer and the transparent conductive layer, while the filament provides support for the protective paint; the protective paint completely wraps the transparent conductive layer; a thickness of the protective paint equals to a diameter of the filament. The protective paint interacts with the filament to effectively improve softness, smoothness, firmness and stretchability of the electroluminescent fiber. As a result, appearance, hand feeling and softness of the electroluminescent fiber are similar to those of common fiber, which is beneficial to embroidery and sewing, and is beneficial to the integration of clothing. In the present invention, the filaments can be combined into a thread, which can be tightly wound on the transparent conductive layer and completely covered by the protective paint without affecting the softness and functionality of the electroluminescent fiber. The transparent insulating protective paint can be polyurethane, acrylic, epoxy resin, silicone, fluorine coating, TPU, PU, liquid wax, etc.

The metal core wires are arbitrarily combined in even numbers into two groups of electrodes, and the 20-36V safe voltage is provided by a special driver for emitting light. Due to the structure of the present invention, quantities of the electrodes in the two groups needs to be the same, so that the capacitance and current can be the same, and the luminous intensity can also be the same. The driver used in the present invention provides the safe voltage of 20-36V, 36-90V or higher. The higher the voltage is, the brighter the light will be. With a special device, the present invention can be used with AC110-220V city power supply, so as to be made into luminous power cables for mobile luminous power cable plug-in cables and mobile luminous power cable roulette cables, which uses light to display working status and position of the cable to improve safety at night. To use DC 3-12V, frequency conversion and voltage conversion by the driving device are required. It is also possible to use inductive chips to drive light-emitting or use conventional display multiplexing chips to drive matrix light-emitting, so as to achieve various flickering effects. Due to the structure of the present invention, a starting voltage is lower than that of the conventional light-emitting fiber. However, high voltage can be used directly due to the safety of the present invention.

The electroluminescent fiber is used for garment sewing or embroidery thread in an independent form, a multi-strand parallel form or a multi-strand winding form for achieving colored transparent conductive layer patterns, so that a garment or a pattern emits light under the safe voltage. The electroluminescent fiber can be mixed with conventional textile threads since hand feelings and usage are the same. Combinations of multiple electroluminescent fibers can also be used for pattern combinations. The color of electroluminescent fiber can be realized by luminescent materials and fluorescent dyes, or by coloring the protective paint and the filament.

The electroluminescent fiber uses colored fluorescence in the filament to show colors, and the filament with the colored fluorescence wraps the transparent conductive layer, in such a manner that emitted light is soft. Distribution of the fluffy filament with the colored fluorescence can greatly improve a luminous area of the electroluminescent fiber and increase visual effects. The colored fluorescence in the filament is stable and durable. Changing the emission color, especially using blue electroluminescence, can excite fluorescent dyes, whose effect is better than that of adding fluorescent dyes to a plastic sheath of the conventional light-emitting thread.

Advantages of the present invention are as follows.

1. The flexible electroluminescent fiber of the present invention is wrapped with a pasted filament. The surface does not use conventional solid plastic masterbatch, but uses a liquid coating to form a protective film, which is soft, large in tension, resistant to bending, silky and smooth, and identical to sewing threads in appearance and performance. At the same time, it can protect the electroluminescent fiber from being scratched and damaged. The small diameter is suitable for spinning, clothing, embroidery, sewing, weaving, and is widely used in safety clothing, luminous displays, and festival accessories. The electroluminescent fiber of the present invention has low cost, mature technology and simple structure, which can be used for luminous display and lighting such as clothing, shoes and hats, embroidery, curtains, tablecloths, paper, bags, umbrellas, lighting sources, traffic signs, animal and plant growth, ropes, etc.

2. The flexible electroluminescent fiber of the present invention has no external electrode, which is difficult to be damaged. A bending angle can be less than 10 degrees, and a pulling force is greater than 5 kilograms. Luminescence is not affected by the external electrode. By controlling the coating of the transparent conductive layer, a multi-channel flicker control effect can be replaced. A weight per meter of the flexible electroluminescent fiber is only 20-30% of the conventional luminescent fiber, and the diameter can be 0.1-0.4 mm which is similar to textile embroidery thread, so as to be used for luminescence, display and illumination in car decoration, household appliances, electronic products, watches, mobile phones, safety power luminous cables, communication optical fiber pipeline indications, medical treatment, matrix display, safety luminous ropes, luminous safety direction indication supplies, etc. The present invention can be used for binding paper, books and periodicals, and can play an anti-counterfeiting effect by lighting. The present invention can also be used in sporting goods for being splendid at night.

3, The flexible electroluminescent fiber of the present invention has a low starting voltage, and an operating voltage is within a safety standard, while the operating voltage of conventional electroluminescence is more than 100V. A commercially available DC3V driver DH2-3-T can usually drive 3-5 m of conventional light-emitting thread, while it can drive 30 m of the flexible electroluminescent fiber of the present invention. As a result, the present invention has higher safety when contacting with human body, and can be made into sensors for water, moisture, voltage, temperature, etc. The present invention can be fixed by pasting, embedding, injection molding, and slotting, and can be used for all kinds of luminous toys, furniture, construction, electricity, navigation safety clothing, instrumentation, aviation, advertising and other luminous display.

An embodiment of the present invention has been described above. It should be understood to those skilled in the art that, without departing from the spirit and scope of the present invention, any modification and improvement made to the present invention are within the scope of the present invention.

What is claimed is:

1. A flexible electroluminescent yarn for embroidery, sequentially consisting of: metal core wires, a light-emitting layer, a transparent conductive layer, a filament, and a coating layer, wherein a quantity of the metal core wires is an even number, and the metal core wires are wrapped by the light-emitting layer; the light-emitting layer is coated with the transparent conductive layer; the coating layer and the filament are exterior to the transparent conductive layer; wherein the metal core wires are enameled copper wires with a diameter of 0.01-0.05 mm; a quantity of the enameled copper wires is an even number, and capacitances of the enameled copper wires are identical; wherein the transparent conductive layer is wrapped with the filament, and the filament is transparent or translucent; the filament is organic filament with a diameter of 0.005-0.01 mm, the filament is a polypropylene fiber or a polyurethane fiber; wherein the filament is segmentally coated with the coating layer which is colorless, transparent and insulating; the coating layer bonds the filament to surfaces of the light-emitting layer and the transparent conductive layer, while the filament provides support for the coating layer; the coating layer completely wraps the transparent conductive layer; a thickness of the coating layer equals to a diameter of the filament; the metal core wires emit light through energizing without using an external electrode; a diameter of the electroluminescent yarn is 0.1-0.3 mm, and the electroluminescent yarn adopts a 20-36V safe voltage for emitting light.

2. The flexible electroluminescent yarn, as recited in claim 1, wherein the metal core wires are evenly wrapped by the light-emitting layer, and a thickness of the light-emitting layer is 0.03 mm; the light-emitting layer is formed by an electroluminescent material and an elastic paint.

3. The flexible electroluminescent yarn, as recited in claim 1, wherein the light-emitting layer is continuously coated by the transparent conductive layer; the transparent conductive layer is nano-conductive ITO (Indium Tin Oxide), zinc oxide, nano-silver wires, or conductive polymers; alternatively, the transparent conductive layer coats segmentally or coats on one side for one-side luminescence, or the transparent conductive layer coats thinly for gradient luminescence.

4. The flexible electroluminescent yarn, as recited in claim 1, wherein the metal core wires are arbitrarily combined in even numbers into two groups of electrodes.

5. The flexible electroluminescent yarn, as recited in claim 1, wherein the electroluminescent yarn is used for garment sewing or embroidery thread in an independent form, a multi-strand parallel form or a multi-strand winding form, so that a garment or a pattern emits light under the safe voltage.

6. The flexible electroluminescent yarn, as recited in claim 1, wherein the electroluminescent yarn uses colored fluorescence in the filament to show colors, and the filament with the colored fluorescence wraps the transparent conductive layer, in such a manner that emitted light is soft and a luminous area of the electroluminescent yarn is increased.

* * * * *